US011873616B2

(12) United States Patent
Coulson

(10) Patent No.: US 11,873,616 B2
(45) Date of Patent: Jan. 16, 2024

(54) BUCKET FOR AN EARTH-WORKING OR MATERIALS-HANDLING MACHINE

(71) Applicant: SSAB TECHNOLOGY AB, Stockholm (SE)

(72) Inventor: Brian Coulson, Durham (GB)

(73) Assignee: SSAB TECHNOLOGY AB, Stockholm (SE)

( * ) Notice: Subject to any disclaimer, the term of this patent is extended or adjusted under 35 U.S.C. 154(b) by 301 days.

(21) Appl. No.: 17/290,865

(22) PCT Filed: Dec. 6, 2019

(86) PCT No.: PCT/EP2019/084023
§ 371 (c)(1),
(2) Date: May 3, 2021

(87) PCT Pub. No.: WO2020/115295
PCT Pub. Date: Jun. 11, 2020

(65) Prior Publication Data

US 2021/0372075 A1 Dec. 2, 2021

(30) Foreign Application Priority Data

Dec. 7, 2018 (EP) ..... 18211055

(51) Int. Cl.
*E02F 3/40* (2006.01)

(52) U.S. Cl.
CPC ..... *E02F 3/40* (2013.01); *E02F 3/401* (2013.01)

(58) Field of Classification Search
CPC ..... E02F 3/40; E02F 3/401; E02F 3/60; E02F 3/369; E02F 3/3604
See application file for complete search history.

(56) References Cited

U.S. PATENT DOCUMENTS 1,573,128 A * 2/1926 Baker ..... E02F 3/60 37/398
3,249,245 A * 5/1966 Foster ..... E02F 3/401 414/724

(Continued)

FOREIGN PATENT DOCUMENTS

AU 2015100869 7/2015
CN 201095774 8/2008

(Continued)

OTHER PUBLICATIONS

U.S. Appl. No. 17/299,045, filed Jun. 2, 2021, SSAB Technology AB.

(Continued)

*Primary Examiner* — Adam J Behrens
*Assistant Examiner* — Blake E Scoville
(74) *Attorney, Agent, or Firm* — Ballard Spahr LLP

(57) ABSTRACT

Described is a bucket for an earth-working or materials-handling machine, having a top portion comprising a web section, a first and a second bucket side wall and a bucket floor extending from a front cutting edge of the bucket up to the top portion. The front cutting edge, the first and second side walls and the top portion form an opening of the bucket, seen from a front view of the bucket. The bucket has a first inner reinforcement beam element provided on an inside of the bucket adjacent the opening, connecting the first side wall to the web section and extending in a width direction (w) of the bucket from the first side wall towards the second side wall, wherein the first inner reinforcement beam element and the web section, as seen in a sectional plane taken perpendicularly to the width direction (w), form a first perimeter profile enclosing an area. The bucket further has a second inner reinforcement beam element provided on an inside of the bucket adjacent the opening, connecting the second side wall to the web section and extending in the (Continued)

width direction (w) of the bucket from the second side wall towards the first side wall, wherein the second inner reinforcement beam element and the web section, as seen in a sectional plane taken perpendicularly to the width direction (w), form a second perimeter profile enclosing an area. The first and the second inner reinforcement beam elements extend in the width direction (w) such that they abut each other at a region between the first and the second side walls, and the first and the second inner reinforcement beam elements further being formed such that a height of the first and second perimeter profile, respectively, decreases towards the region.

16 Claims, 4 Drawing Sheets

(56) References Cited

U.S. PATENT DOCUMENTS

| | | | | |
|---|---|---|---|---|
| 3,578,375 | A | 5/1971 | Finefrock | |
| 4,043,060 | A | 8/1977 | Stepe | |
| 4,110,921 | A | 9/1978 | Poker, Jr. | |
| 4,129,952 | A | 12/1978 | Olson | |
| 4,476,641 | A | 10/1984 | Ballinger | |
| 5,063,694 | A * | 11/1991 | McCreary, Jr. | E02F 3/40 37/444 |
| 5,680,717 | A | 10/1997 | Bierwith | |
| 6,154,989 | A * | 12/2000 | Kaczmarski | E02F 3/3686 37/444 |
| 8,052,193 | B2 | 11/2011 | Liebert | |
| 8,464,443 | B2 | 1/2013 | Torgrimsen | |
| 9,428,881 | B1 * | 8/2016 | Chabura | E02F 3/40 |
| 9,995,285 | B2 | 6/2018 | Ehrsam | |
| 10,815,638 | B2 | 10/2020 | Voelz et al. | |
| 2005/0268500 | A1 * | 12/2005 | Imamura | E02F 3/40 37/411 |
| 2008/0282585 | A1 | 11/2008 | Cox | |
| 2009/0183398 | A1 * | 7/2009 | McClallen | E02F 3/40 37/444 |
| 2013/0078069 | A1 * | 3/2013 | May | E02F 9/006 29/401.1 |
| 2013/0164106 | A1 | 6/2013 | Clause et al. | |
| 2014/0237869 | A1 * | 8/2014 | Caux | E02F 3/40 37/444 |
| 2015/0110592 | A1 | 4/2015 | Voelz | |
| 2016/0046244 | A1 | 2/2016 | Chewning | |
| 2016/0130791 | A1 | 5/2016 | Serrurier et al. | |
| 2017/0314236 | A1 | 11/2017 | Long | |
| 2018/0274201 | A1 * | 9/2018 | Kunz | E02F 9/2825 |
| 2020/0123732 | A1 * | 4/2020 | Hall | E02F 9/2883 |

FOREIGN PATENT DOCUMENTS

| | | | | |
|---|---|---|---|---|
| CN | 103097615 | A | 5/2013 | |
| CN | 104011303 | A | 6/2013 | |
| CN | 105765131 | A | 7/2016 | |
| CN | 206346240 | | 7/2017 | |
| EP | 0108957 | A1 * | 5/1984 | |
| FR | 2 691 126 | A | 11/1993 | |
| GB | 2 272 008 | | 5/1994 | |
| JP | S51131001 | | 10/1976 | |
| JP | S5244601 | | 4/1977 | |
| JP | H0720336 | | 4/1995 | |
| JP | 2014070430 | | 4/2013 | |
| JP | 2017014751 | A | 1/2017 | |
| KR | 20130002388 | U * | 3/2013 | |
| KR | 20130107705 | | 10/2013 | |
| RU | 39147 | U1 | 7/2004 | |
| RU | 2429146 | | 9/2011 | |
| WO | WO-2011011825 | A1 * | 2/2011 | E02F 3/40 |
| WO | WO 2013/032429 | | 3/2013 | |
| WO | WO 2015/006809 | | 1/2015 | |
| WO | WO-2015006809 | A1 * | 1/2015 | E02F 3/342 |
| WO | WO 2016/061609 | | 4/2016 | |
| WO | WO 2020/115298 | | 6/2020 | |
| WO | WO 2020/115300 | | 6/2020 | |

OTHER PUBLICATIONS

U.S. Appl. No. 17/299,041, filed Jun. 2, 2021, SSAB Technology AB.

PCT/EP2019/084028 (WO 2020/115298), filed Dec. 6, 2019, SSAB TECHNOLOGY AB.

PCT/EP2019/084031 (WO 2020/115300), filed Dec. 6, 2019, SSAB TECHNOLOGY AB.

International Search Report and Written Opinion dated Feb. 3, 2020 by the International Searching Authority for International Application No. PCT/EP2019/084023, filed on Dec. 6, 2019 and published as WO 2020/115295 on Jun. 11, 2020 (Applicant—SSAB Technology AB) (12 Pages).

International Search Report and Written Opinion dated Feb. 10, 2020 by the International Searching Authority for International Application No. PCT/EP2019/084031, filed on Dec. 6, 2019 and published as WO 2020/115300 on Jun. 11, 2020 (Applicant—SSAB Technology AB, (10 Pages).

International Search Report and Written Opinion dated Feb. 3, 2020 by the International Searching Authority for International Application No. PCT/EP2019/084028, fied on Dec. 6, 2019 and published as WO 2020/115298 on Jun. 11, 2020 (Applicant—SSAB Technology AB, (11 Pages).

Hiroshi Sunada, "Development of Wear-resistant Bucket (e-Bucket) for PC200 Senes," Komatsu Technical Report, vol. 50, No. 103, (Dec. 1, 2004) pp. 1-6.

* cited by examiner

BUCKET FOR AN EARTH-WORKING OR MATERIALS-HANDLING MACHINE

CROSS-REFERENCE TO RELATED APPLICATIONS

This application is a U.S. National Phase Application of International Application No. PCT/EP2019/084023, filed Dec. 6, 2019, which claims priority to European Application No. 18211055.1, filed Dec. 7, 2018, each of which are hereby incorporated by reference in their entirety.

TECHNICAL FIELD

The present disclosure relates to a bucket for an earth-working or materials-handling machine, the bucket comprising a top portion comprising a web section, a first and a second bucket side wall, and a bucket floor extending from a front cutting edge of the bucket up to the top portion, wherein the front cutting edge, the first and second side walls and the top portion form an opening of the bucket, as seen from a front view of the bucket.

BACKGROUND

Earth-working or materials-handling machines, such as excavators, are widely used in the construction and mining industries to move material, such as earth, sand, rocks and snow. In many of these applications, buckets are used to pick up and transport material and for example load it onto a truck or move it to a different location.

Buckets are commonly made of steel and provided in different sizes, to thereby be adapted for machines of different sizes and machines having different lifting capacities. Hence, when selecting an appropriate bucket size for a specific machine, the lifting capacity of the machine may be considered. The lifting capacity may be defined as the maximum weight the machine may lift. For example, when the machine is an excavator with an excavator arm holding a bucket, a suitable bucket for the excavator may be selected by controlling that the excavator arm will not exceed the maximum suspended load capacity of the excavator when the arm is fully extended. Maximum suspended load capacity may hence be defined as the maximum weight the outermost portion of the arm may accommodate when the arm is completely extended in a horizontal direction out from the excavator.

When selecting an appropriate bucket size, not only the weight of the bucket has to be considered, but also one needs to consider the amount of material that can be loaded in the bucket. Hence, the bucket selection depends on bucket weight and the weight of the material in the bucket, when fully loaded. Hence, an efficient bucket should have a large loading volume in relation to its weight (when empty), i.e. the loading volume and bucket weight ratio should be as high as possible without negatively affecting the bucket's strength.

SUMMARY

In view of the above, an object of the present disclosure is to provide an improved light-weight bucket having high strength.

According to a first aspect, the object is achieved by the subject matter in claim 1. Further embodiments of the disclosure may be found in the dependent claims and in the accompanying description and drawings.

According to the first aspect, the object is achieved by a bucket for an earth-working or materials-handling machine, comprising, a top portion comprising a web section, a first and a second bucket side wall, a bucket floor extending from a front cutting edge of the bucket up to the top portion, the front cutting edge, the first and second side walls and the top portion forming an opening of the bucket, as seen from a front view of the bucket. Moreover, the bucket comprises a first inner reinforcement beam element provided on an inside of the bucket adjacent the opening, connecting the first side wall to the web section and extending in a width direction of the bucket from the first side wall towards the second side wall, wherein the first inner reinforcement beam element and the web section, as seen in a sectional plane taken perpendicularly to the width direction, form a first perimeter profile enclosing an area. The bucket further comprises a second inner reinforcement beam element provided on an inside of the bucket adjacent the opening, connecting the second side wall to the web section and extending in the width direction of the bucket from the second side wall towards the first side wall, wherein the second inner reinforcement beam element and the web section, as seen in a sectional plane taken perpendicularly to the width direction, form a second perimeter profile enclosing an area. The first and the second inner reinforcement beam elements extend in the width direction such that they abut each other at a region between the first and the second side walls, and the first and the second inner reinforcement beam elements are further formed such that a height of the first and second perimeter profile, respectively, decreases towards the region.

The expression web section as used herein means a section of material having a length, a width and a thickness, wherein the length and/or the width of the section of material is substantially larger than the thickness, such as 5, 10, 15, 20 or more times larger than the thickness. Preferably, both the length and the width are substantially larger than the thickness. More preferably, the web section may be made of steel, preferably sheet metal.

The expression stating that the first and the second reinforcement elements abut each other, means that abutting end portions of the respective elements are contacting each other, or at least are positioned in the proximity of each other, with a shortest distance between them being 10, 9, 8, 7, 6, 5, 4, 3, 2, 1 centimeter(s) or less. Still optionally, abutting end portions of the first and second inner reinforcement beam elements may be connected by a weld. This may provide a more robust inner reinforcement beam element which extends from the first side wall to the second side wall. Still optionally, the first and second inner reinforcement beam elements may be made by one single piece. Hence, the abutting ends may be connected already prior to mounting the first and second inner reinforcement beam elements to the bucket.

The bucket has a width which is defined by an extension between the first and the second bucket side walls. The width of the bucket extends in a width direction, or a transverse direction, which direction may be defined as a direction which is perpendicular to, or substantially perpendicular to, a sectional plane defined by one of the first and second side walls.

The expression "perimeter profile" as used herein may mean an outer profile of a member, such as an outer profile forming the outer limits of the member. Hence, the expression "perimeter profile enclosing an area" as used herein may mean an outer profile formed by the respective inner reinforcement beam element and the web section, which is enclosing an area. The area is preferably empty without any material portion therein, i.e. hollow, thereby contributing to a reduced weight of the bucket, whilst providing a high-strength configuration.

By the provision of the bucket as defined in the above, a light-weight and high strength bucket configuration is achieved. More particularly, the configuration of the reinforcement beam elements together with the web section has shown to form a robust top portion which can accommodate large loads, especially in a height direction of the bucket, whilst keeping the bucket weight as low as possible. Therefore, the bucket configuration may allow a larger bucket loading volume, which in turn may improve the efficiency for the machine using the bucket. Preferably, the first and second inner reinforcement beam elements are connected to the respective side walls and/or to the web section by a weld. Still optionally, the first and second perimeter profiles enclosing an area preferably extend in the width direction such that they form a first and second hollow profile at the top portion of the bucket. Such hollow profiles have shown to provide at least a portion of a beam-like element which is light in weight and provides high strength. Furthermore, the configuration of the top portion allows making use of a thinner web section and thinner inner reinforcement beam elements, preferably thinner sheet metal elements, thereby reducing bucket weight further.

Optionally, the first inner reinforcement beam element and/or the second inner reinforcement beam element may be provided at the top portion of the bucket, preferably only provided at the top portion.

The decreasing heights of the perimeter profiles, which decreases from each side wall towards the region, will provide a shape which is advantageous in that an outwardly bent beam-like profile may be formed at the top portion, as seen from the front view of the bucket. Such profile at the top portion has been found to provide high carrying capacity. The outwardly bent beam-like profile is hence configured such that it extends in the width direction from the first side wall to the second side wall. When the bucket is lifted upwardly, the top portion may deflect outwardly. By configuring the top portion as in the above, the resulting deflection of the top portion caused by lifting the bucket may be reduced, thereby also reducing internal stresses in the bucket. As a consequence, the strength of the bucket may be further increased. Reduced internal stresses may for example be beneficial for possible welds of the bucket, and may increase the fatigue life of the welds.

Optionally, the bucket, on an outside thereof, may comprise a connection member for connecting the bucket to the earth-working or materials-handling machine. Still optionally, the connection member may be attached to the web section, preferably by a weld. The weld may due to the bent beam-like configuration of the top portion be exposed to reduced internal stresses, thereby increasing fatigue life of the weld. Still optionally, the connection member may be further attached to an outside of the bucket floor, preferably by a weld.

Optionally, a portion of the web section may extend outwardly from the opening in an opposite direction with respect to a filling direction for the bucket, forming an outwardly extending web section portion. It has been found that such an outwardly extending web section portion may further increase bucket strength. Still optionally, the outwardly extending web section portion may further protrude downwardly towards the front cutting edge, preferably such that it forms a downwardly projecting nose portion. This may even further improve bucket strength. In the event the bucket comprises a connection member as in the above, the connection member may be attached to the outwardly extending web section portion, preferably by a weld. Still optionally, the downwardly projecting nose portion may be formed by bending the outwardly extending web section portion downwardly towards the front cutting edge.

Optionally, at least one of the side walls may comprise a side wall portion in the proximity of the top portion, which side wall portion extends in the width direction towards the web section. Still optionally, the side wall portion may be attached to the web section, preferably by a weld. Preferably, the weld is offset from a bucket corner between the respective side wall and the top portion. Hence, the configuration of the side wall portion may avoid providing a weld at any one of the bucket corners. Thereby the weld(s) may be exposed to reduced stress, which in turn may improve bucket strength.

Optionally, the bucket may further comprise at least one outer reinforcement beam element provided on an outside of the bucket, on the top portion thereof and adjacent the opening, connecting the first and the second side walls to the web section and extending in the width direction of the bucket between the first and second side walls, wherein the at least one outer reinforcement beam element and the web section, as seen in a sectional plane taken perpendicularly to the width direction, forms a third perimeter profile enclosing an area. Thereby, the inner reinforcement beam elements, the web section and the at least one outer reinforcement beam element may together form a light-weight beam-like profile in the bucket's width direction, which extends from the first side wall to the second side wall. Still optionally, the at least one outer reinforcement beam element may be formed such that a height of the third perimeter profile increases towards a region of the top portion in-between the first and second side walls, for example the region being a mid-point therebetween. Thereby, the inner reinforcement beam elements and the at least one outer reinforcement beam element may together form an outwardly bent beam-like profile at the top portion, when seen from the front view of the bucket. Therefore, deflections caused by lifting the bucket may be reduced, resulting in reduced internal stresses in the bucket. In other words, the reinforcement beam elements together with the web section are configured to form an angular or bent top section pointing outwards from the bucket or bucket loading volume, thereby extending or widening the opening of the bucket. Or put differently, the reinforcement beam elements together with the web section are configured to form an inverted v-shaped top section or an outwardly pointing arrow shaped top section, thereby extending or widening the opening of the bucket.

Optionally, the bucket may comprise more than one outer reinforcement beam element, such as 2, 3, 4, 5 or more reinforcement beam elements, provided consecutively in the width direction.

Optionally, the web section may comprise an end portion being distal to the opening, the distal end portion comprising a protruding portion extending in the width direction and protruding downwardly towards the inside of the bucket through a slit of the bucket floor. This configuration may provide a robust connection to the bucket floor, which especially may accommodate large loads in the bucket floor's length extension between the front cutting edge and the top portion, thereby further improving bucket strength.

Optionally, at least one of the web section, the first inner reinforcement beam element, the second inner reinforcement beam element and the at least one outer reinforcement beam element may be made of sheet metal.

Optionally, at least one of the first and second inner reinforcement beam elements may have a substantially U-shaped, V-shaped, curved-shaped, such as semi-circular-shaped, cross sectional profile, as seen in the sectional plane taken perpendicularly to the width direction. As such, the U-shaped, V-shaped, curved-shaped, such as semi-circular-shaped, cross sectional profile of the at least one first and second inner reinforcement beam elements may together with the web section form the first and/or second perimeter profile enclosing an area.

Optionally, the at least one outer reinforcement beam element may have a substantially U-shaped, V-shaped, curved-shaped, such as semi-circular-shaped, cross sectional profile, as seen in the sectional plane taken perpendicularly to the width direction. As such, the U-shaped, V-shaped, curved-shaped, such as semi-circular-shaped, cross sectional profile of the at least one outer reinforcement beam element may together with the web section form the third perimeter profile enclosing an area.

Optionally, the first and the second inner reinforcement beam elements abut each other substantially at a central sectional plane taken perpendicularly to the width direction, which central sectional plane is located substantially half-way in-between the first and the second side walls as seen in the bucket's width direction, with substantially equal distances to the first and the second side walls. Still optionally, the central sectional plane may also define a plane of symmetry for the top portion and/or for the bucket.

Optionally, the connection member may be provided as one or more separate elements, and may further be provided in-between adjacent outer reinforcement beam elements, as seen in the width direction of the bucket. For example, if the connection member comprises two separate elements, there may be three outer reinforcement beam elements on the top portion arranged consecutively in the width direction of the bucket. Furthermore, if the connection member comprises for example three or four separate elements, there may be four or five outer reinforcement beam elements, respectively, on the top portion arranged consecutively in the width direction of the bucket.

Optionally, the front cutting edge of the bucket may be formed such that the opening at the front cutting edge forms a concave-shaped profile facing the top portion, when seen from the front view of the bucket. Further forming the bucket such that the opening attains a more smooth curved-like shape, when seen from the front view of the bucket, may further reduce internal stresses in the bucket when in use. Thereby, a light-weight and high strength bucket may be provided.

According to a second aspect, the object is achieved by a method for manufacturing a bucket for an earth-working or materials-handling machine according to anyone of the embodiments of the first aspect. The bucket comprises a top portion comprising a web section, a first and a second bucket side wall, a bucket floor extending from a front cutting edge of the bucket up to the top portion, the front cutting edge, the first and second side walls and the top portion forming an opening of the bucket, seen from a front view of the bucket. The method comprising the following step:

providing a first inner reinforcement beam element on an inside of the bucket adjacent the opening, the first inner reinforcement beam element connecting the first side wall to the web section and extending in a width direction of the bucket from the first side wall towards the second side wall, wherein the first inner reinforcement beam element and the web section, as seen in a sectional plane taken perpendicularly to the width direction, form a first perimeter profile enclosing an area. The method further comprises the following step:

providing a second inner reinforcement beam element on an inside of the bucket adjacent the opening, the second inner reinforcement beam element connecting the second side wall to the web section and extending in the width direction of the bucket from the second side wall towards the first side wall, wherein the second inner reinforcement beam element and the web section, as seen in a sectional plane taken perpendicularly to the width direction, form a second perimeter profile enclosing an area. The first and the second inner reinforcement beam elements extend in the width direction such that they abut each other at a region between the first and the second side walls, and the first and the second inner reinforcement beam elements further being formed such that a height of the first and second perimeter profile, respectively, decreases towards the region.

It shall be noted that all embodiments and related advantages of the first aspect are applicable to all embodiments of the second aspect, and vice versa.

Optionally, the method may further comprise the step of providing at least one outer reinforcement beam element on an outside of the bucket, on the top portion thereof and adjacent the opening, connecting the first and the second side walls to the web section and extending in the width direction of the bucket between the first and second side walls, wherein the at least one outer reinforcement beam element and the web section, as seen in a sectional plane taken perpendicularly to the width direction, forms a third perimeter profile enclosing an area.

Preferably, the web section, the first and second side walls, the inner reinforcement beam elements and/or the at least one outer reinforcement beam element may be connected by a welding operation. Further, also other members of the bucket may be connected by welding operations.

BRIEF DESCRIPTION OF THE DRAWINGS

With reference to the appended drawings, below follows a more detailed description of embodiments of the disclosure cited as examples.

In the drawings.

Figure 1:
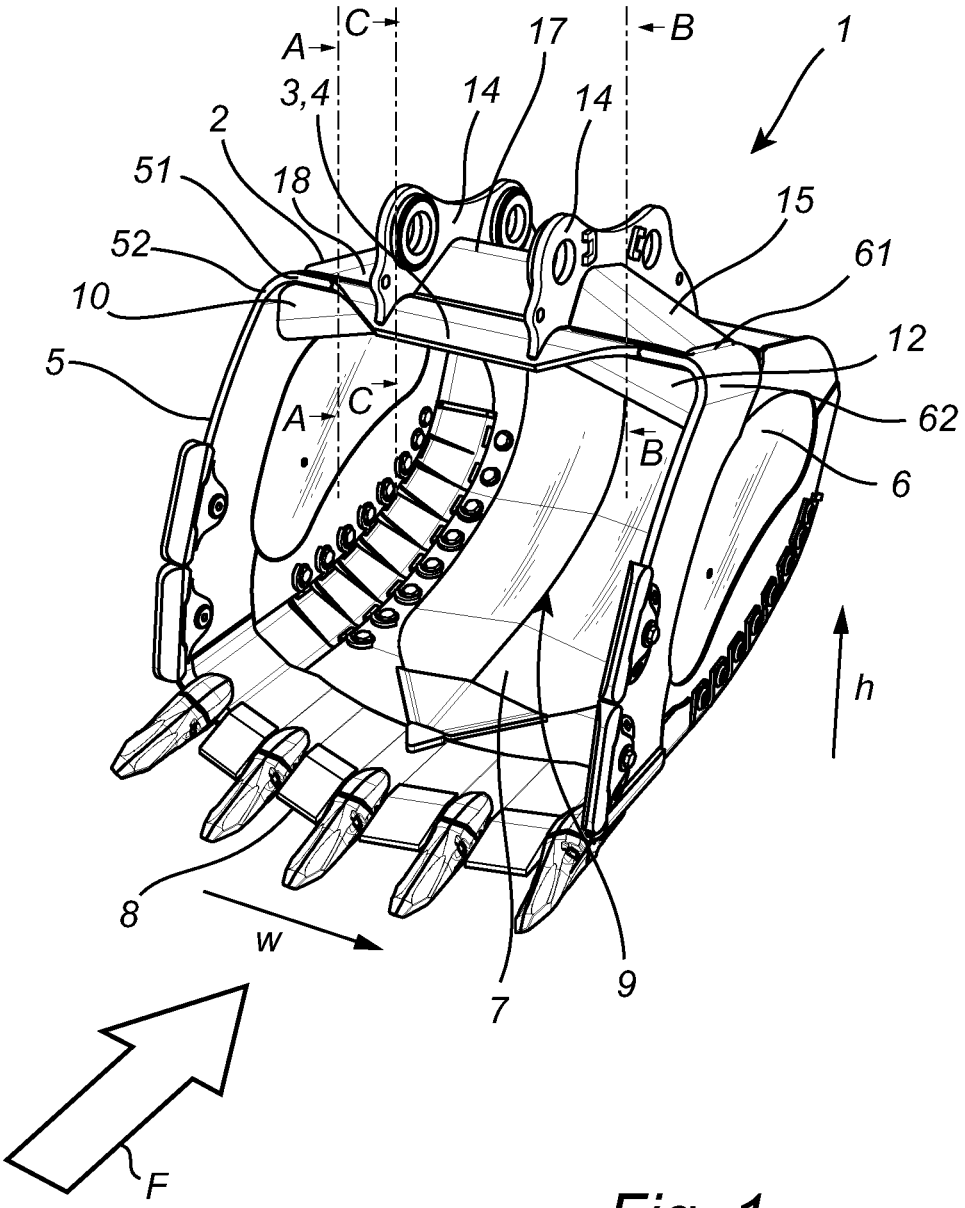
FIG. 1 shows a bucket according to an embodiment of the present disclosure.

The drawings show diagrammatic exemplifying embodiments of the present disclosure and are thus not necessarily drawn to scale. It shall be understood that the embodiments shown and described are exemplifying and that the invention is not limited to these embodiments. It shall also be noted that some details in the drawings may be exaggerated in order to better describe and illustrate the particular embodiment. Like reference characters refer to like elements throughout the description, unless expressed otherwise.

DETAILED DESCRIPTION OF PREFERRED EMBODIMENTS

A bucket according to embodiments described herein is suitable for use with any earthmoving or materials-handling machine, such as a compact excavator, a dragline excavator, amphibious excavator, power shovel, steam shovel, suction excavator, walking excavator, bucket wheel excavator, a bulldozer, a loader, mining equipment, a tractor, a skid steer loader etc. The earth-moving or materials-handling machine may be a ground engaging machine, or may have a bucket that is arranged to engage some other surface, such as a pit wall in open pit mining.

The earth-moving or materials-handling machine may for example be used for digging a trench, hole or foundations, in forestry work, construction, landscaping, mining, river dredging or snow removal.

Figure 2A:
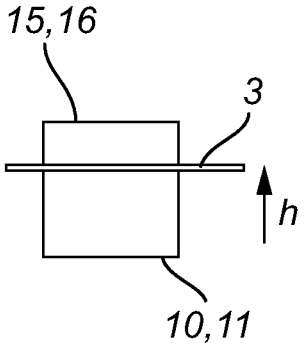
FIGS. 2*a*-2*c* show cross sectional views of a top portion according to embodiments of the present disclosure and FIG. 2*d* shows a schematic illustration of a top portion of a bucket according to an embodiment of the disclosure.
Figure 2B:
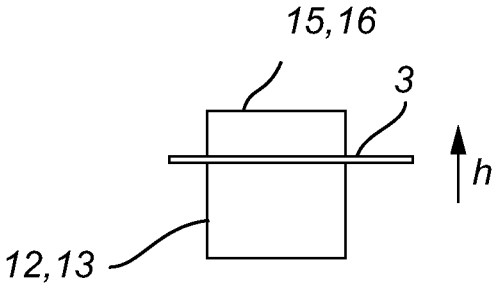
Figure 2C:
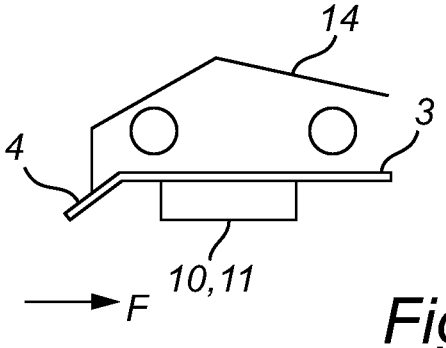
Figure 2D:
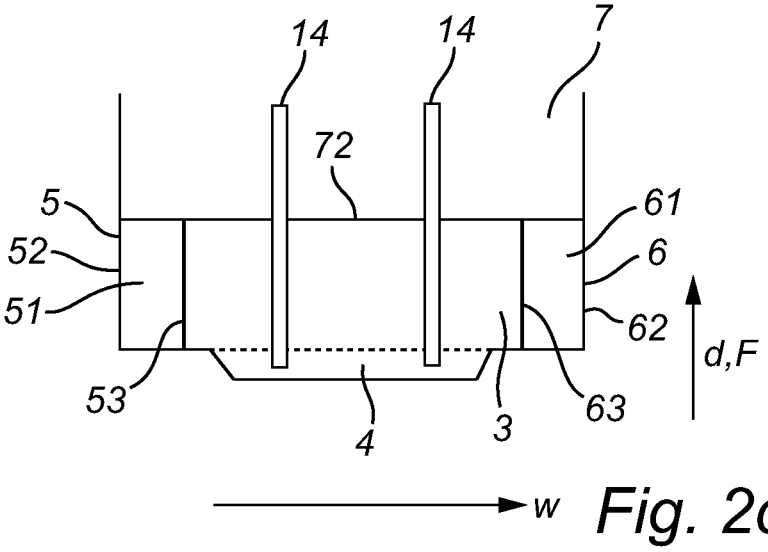
Figure 3:
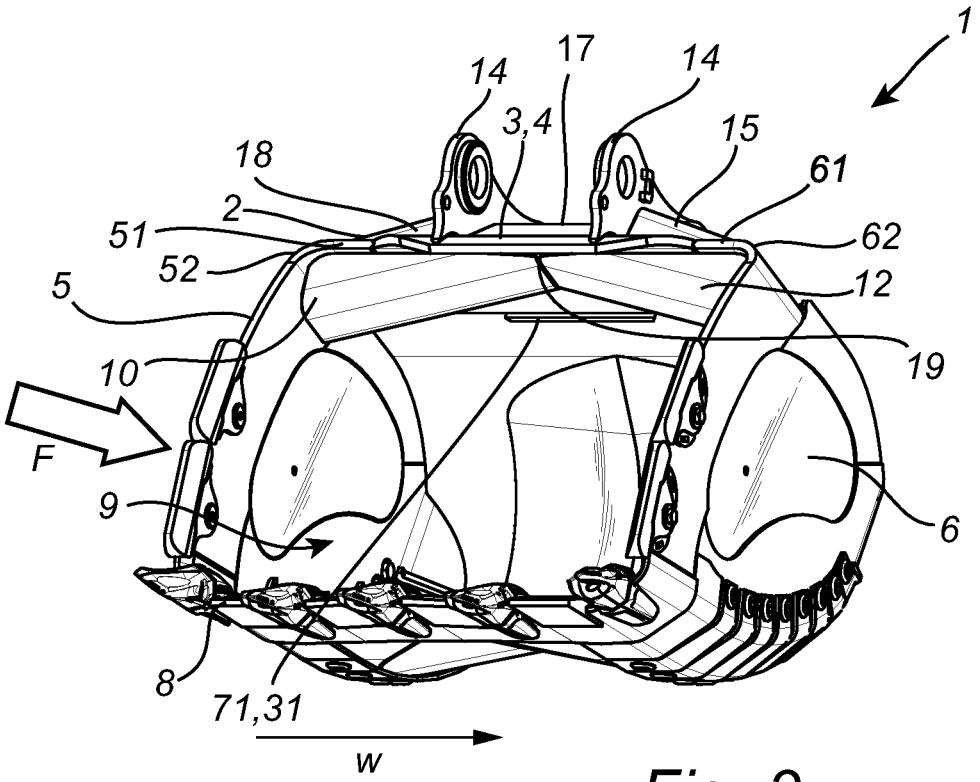
FIG. 3 shows another view of the bucket as shown in FIG. 1.
Figure 4:
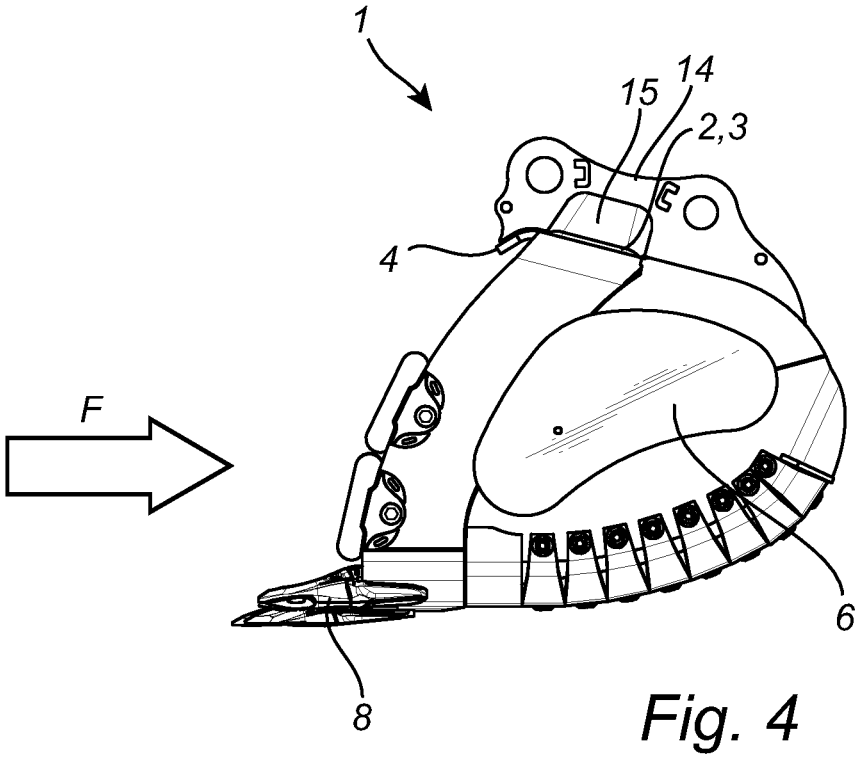
FIG. 4 shows a side view of the bucket as shown in FIG. 1.
Figure 5:
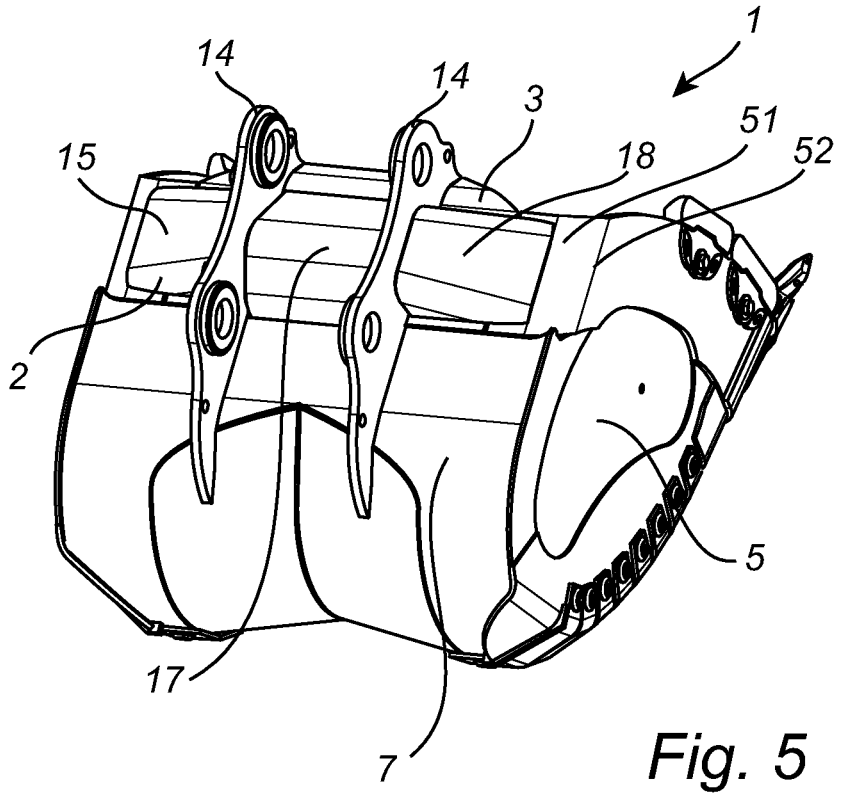
FIG. 5 shows a view from behind of the bucket as shown in FIG. 1.
Figure 6:
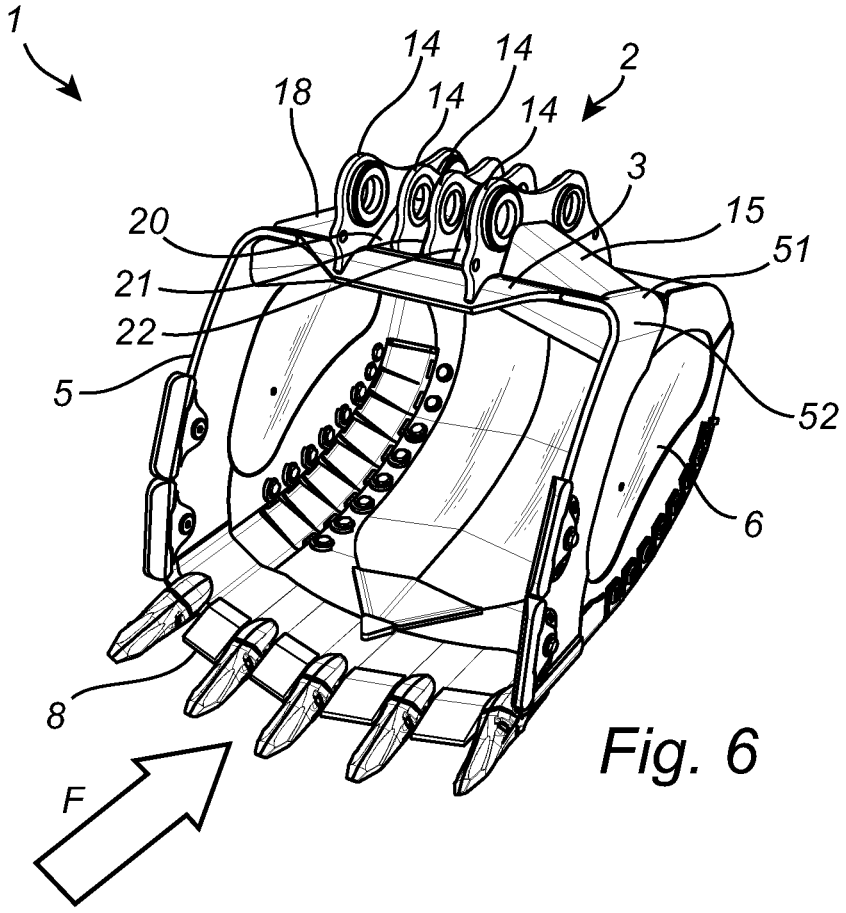
FIG. 6 shows a bucket according to an embodiment of the present disclosure.

FIGS. 1-5 show views of a bucket 1 for an earth-working or materials-handling machine according to an embodiment of the present disclosure. More particularly, FIG. 1 shows a perspective view of the bucket 1 viewed at angle from the front and FIGS. 2*a-c* show cross sectional views of a top portion 2, wherein the cross sections are defined by sectional planes A-A, B-B and C-C, respectively, being perpendicular to the width direction w of the bucket. Moreover, FIG. 2*d* shows a schematic illustration of a top portion of a bucket viewed from above, FIG. 3 shows another front view of the bucket, FIG. 4 shows a view from the side of the bucket and FIG. 5 shows the bucket viewed at angle from behind. FIG. 6 shows another embodiment where the connection member 14 is configured differently.

The bucket 1 as shown in FIGS. 1-5 comprises a top portion 2 comprising a web section 3, a first 5 and a second 6 bucket side wall and a bucket floor 7 extending from a front cutting edge 8 of the bucket up to the top portion 2. The web section 3 of this embodiment is in the form of a plate member made by sheet metal, which has been formed into a specific shape, for example formed in a bending operation. The front cutting edge 8, the first and second side walls, 5 and 6, and the top portion 2 form an opening 9 of the bucket 1, as seen from a front view of the bucket 1.

The bucket 1 further comprises a first inner reinforcement beam element 10 provided on an inside of the bucket adjacent the opening 9, connecting the first side wall 5 to the web section 3 and extending in a width direction w of the bucket from the first side wall 5 towards the second side wall 6, wherein the first inner reinforcement beam element 10 and the web section 3, as seen in a sectional plane taken perpendicularly to the width direction w, form a first perimeter profile 11 enclosing an area. An example embodiment of the perimeter profile 11 is shown in FIG. 2*a*.

In addition, the bucket 1 further comprises a second inner reinforcement beam element 12 provided on an inside of the bucket adjacent the opening 9, connecting the second side wall 6 to the web section 3 and extending in the width direction w of the bucket 1 from the second side wall 6 towards the first side wall 5, wherein the second inner reinforcement beam element 12 and the web section 3, as seen in a sectional plane taken perpendicularly to the width direction w, form a second perimeter profile 13 enclosing an area. An example embodiment of the perimeter profile 13 is shown in FIG. 2*b*.

The first and the second inner reinforcement beam elements, 10 and 12, extend in the width direction w such that they abut each other at a region 19 between the first and the second side walls, 5 and 6, and the first and the second inner reinforcement beam elements 10, 12 further being formed such that a height of the first and second perimeter profile 11, 13, respectively, decreases towards the region 19. Height direction is denoted as h in the figures and is herein a direction which is perpendicular to the width direction. The profile of the opening 9 at the top portion 2 is in this embodiment provided in that the first and the second inner reinforcement beam elements, 10 and 12, taper inwardly toward the region 19 where the elements abut each other. Hence, the sizes of the areas enclosed by the first and the second perimeter profiles, 11 and 13, may be reducing in the direction toward the region 19 where the elements abut each other. As a consequence of this configuration, the first and the second perimeter profiles, 11 and 13, extend in the width direction w such that they form first and second hollow profiles at the top portion 2 of the bucket 1.

Furthermore, on an outside thereof, the bucket 1 comprises a connection member 14 for connecting the bucket to the earth-working or materials-handling machine. The connection member 14 of the embodiment shown in FIGS. 1-5 comprises two separate elements which are separated by an intermediate outer reinforcement beam element 17. The connection members 14 are further attached to the web section 3 by a weld. Still further, in this particular embodiment, the connection member 14 is also attached to an outside of the bucket floor 7 by a weld, which is shown in FIG. 5. The connection member 14 connects the web section 3, the bucket floor 7 and the beam elements, 10, 12, 15, 17 and 18. Thereby, the bucket's stiffness, especially at the top portion 2, has been found to be improved. The connections are preferably made by welds.

A portion 4 of the web section 3 extends outwardly from the opening 9 in an opposite direction with respect to a filling direction F for the bucket 1, forming an outwardly extending web section portion 4. This is shown in e.g. FIGS. 2*c* and 4, where FIG. 2*c* shows a cross sectional view of the top portion 2 taken along a sectional plane C-C as shown in FIG. 1. The outwardly extending web section portion 4 protrudes downwardly towards the front cutting edge 8, such that it forms a downwardly projecting nose portion. The connection member 14 is also attached to the outwardly extending web section portion 4 by a weld, thereby further increasing the bucket's stiffness, especially at its top portion 2. The configuration of the outwardly extending web section portion 4 has for example shown to be beneficial for handling forces exposed to the bucket in different directions. During use of the bucket, i.e. when the bucket is moving and/or pivoting around at least one axle, it will namely be exposed to forces in different directions. By configuring the outwardly extending web section portion 4 such that it protrudes downwardly and such that the connection member 14 is connected thereto, the bucket stiffness may increase. Thereby, a more light-weight bucket configuration may be provided without compromising the bucket's stiffness properties. Furthermore, it has been found that the downwardly projecting nose portion 4 is beneficial for increasing the strength particularly in the middle in-between the side walls 5 and 6. Thereby, the opening 9 at the middle of the top portion 2 can be made larger without compromising bucket strength.

The side wall 5 comprises a side wall portion 51 in the proximity of the top portion 2, which side wall portion 51 extends in the width direction w towards the web section 3. Further, the side wall portion 51 may be attached to the web section 3 by a weld 53, see especially FIG. 2*d*. The weld 53 is offset from a bucket corner 52 between the side wall 5 and the top portion 2. Hence, the configuration of the side wall portion 51 avoids providing a weld at the bucket corner 52. Optionally, the weld may be provided between the web section 3 and the side wall portion 51 such that it extends in a direction being substantially parallel to a depth direction d of the bucket 1. Moreover, the weld may be provided between respective outer end portions of the respective web section 3 and the side wall portion 51, which end portions may lie flush against each other. In a similar manner, the side wall 6 comprises a side wall portion 61 in the proximity of the top portion 2, which side wall portion 61 extends in the width direction w towards the web section 3. Further, the side wall portion 61 is also in this embodiment attached to the web section 3 by a weld 63, see FIG. 2*d*. The weld 63 is offset from a bucket corner 62 between the side wall 6 and the top portion 2. Hence, the configuration of the side wall portion 61 avoids providing a weld also at the other bucket corner 62. Optionally, the weld may also here in a similar manner be provided between the web section 3 and the side wall portion 61 such that it extends in a direction being substantially parallel to the depth direction d of the bucket 1.

Moreover, the weld may also be provided between respective outer end portions of the respective web section 3 and the side wall portion 61, which end portions may lie flush against each other.

The width direction, the depth direction and the height direction as used herein are provided perpendicular with respect to each other, and may be regarded as corresponding to a Cartesian coordinate system.

In the embodiments shown in e.g. FIG. 1 and FIG. 6, the front cutting edge 8 is formed such that the opening 9 at the front cutting edge 8 forms a concave-shaped profile facing the top portion 2, when seen from the front view of the bucket 1. Hence, the bucket 1 may further be configured with a curved-like profile at the front cutting edge 8, thereby further reducing internal stresses, when the bucket is in use. The front cutting edge 8 may be provided with the curved-like profile by bending a metal element into the specific shape, for example by bending a sheet metal element.

FIG. 2*d* shows a schematic illustration viewed from above of an example embodiment of a top portion 2. The outer reinforcement beam elements are here omitted to better illustrate the configuration of the web section 3 and the side wall portions 51 and 61. The web section 3 extends in the width direction w and in a depth direction d of the bucket 1. The web section 3 is connected to the bucket floor 7, preferably by a weld 72 extending substantially in the width direction w. Welds 53 and 63, as previously described in the above, are provided between the web section 3 and the respective side wall portions 51 and 62, in a direction being substantially parallel to the depth direction d of the bucket 1. A connection member 14 is also shown, which here is provided as two separate elements. The two separate elements extend in the depth direction d from the bucket floor 7 to the web section 3 such that it also contacts and is connected to the outwardly extending web section portion 4. The separate elements of the connection member 14 are here attached to the bucket floor 7 and the web section 3, preferably by welds extending substantially in the depth direction d.

The bucket 1 as shown in FIGS. 1-5 comprises three outer reinforcement beam elements, 15, 17 and 18 provided on an outside of the bucket 1, on the top portion 2 thereof and adjacent the opening 9, connecting the first and the second side walls, 5 and 6, to the web section 3 and extending in the width direction w of the bucket between the first and second side walls, wherein the three outer reinforcement beam elements and the web section 3, as seen in a sectional plane taken perpendicularly to the width direction w, forms a third perimeter profile 16 enclosing an area. The perimeter profile 16 is shown in FIGS. 2*a* and 2*b*. The three outer reinforcement beam elements 15, 17 and 18 are here provided consecutively in the width direction w, whereby each respective connection element 14 is provided in-between the beam elements 15 and 17, and 17 and 18, respectively, as seen in the width direction w.

The inner reinforcement beam elements 10 and 12, the web section 3 and the three outer reinforcement beam elements 15, 17 and 18 together form a light-weight beam-like profile in the bucket's width direction, connecting the first side wall 5 to the second side wall 6. Furthermore, the three outer reinforcement beam elements 15, 17 and 18 are formed such that a height of the third perimeter profile 16 increases towards a region of the top portion 2 provided in-between the first and second side walls 5, 6. In this particular embodiment, the outer reinforcement beam elements 15 and 18 are formed such that a height of the third perimeter profile 16 increases towards a region of the top portion 2 provided in-between the first and second side walls 5, 6, whilst the beam element 17 has a constant height in its width direction. Thereby, an outwardly bent beam-like profile is formed which comprises two bending points on the outside of the top portion 2 and one on the inside thereof at the region 19, as seen in the width direction w, which bending points on the outside are located between the beam elements 15, 17 and 17, 18, respectively. As a consequence, the shape of the profile on the inside of the top portion 2 of the bucket 1 and the shape of the profile on the outside thereof together form an outwardly bent beam-like profile at the top portion 2, when seen from the front view of the bucket 1. Optionally, the bucket 1 may comprise more than two such bending points on the outside, or even it may comprise only one such bending point, and still achieve the bent-like beam element profile as mentioned in the above. Likewise, more than one bending point may also be provided on the inside of the top portion.

A similar configuration is shown in the embodiment shown in FIG. 6, with the difference that the connection member 14 of the bucket 1 in FIG. 6 comprises four separate elements 14 instead of two. As a consequence, there will be five outer reinforcement beam elements instead of three, i.e. 15, 18, 20, 21 and 22, which are provided consecutively in the width direction w. The number of separate elements of the connection member 14 may vary depending on e.g. the size of the bucket. Still further, at least one of the separate elements of the connection member 14 may be connected to the outwardly extending web section portion 4. In FIG. 6 it can be seen that the two outer separate elements are connected to the web section portion 4, whilst the two in the middle are not connected thereto. Optionally, all the separate elements of the connection member 14 may be connected to the outwardly extending web section portion 4, preferably by a weld.

Turning now especially to FIG. 3, it can be seen that the web section 3 comprises an end portion 31 being distal to the opening 9, the distal end portion 31 comprising a protruding portion extending in the width direction w and protruding downwardly towards the inside of the bucket 1 through a slit 71 of the bucket floor 7. This configuration may provide a more robust connection to the bucket floor 7, as described in the above.

The web section 3, the first inner reinforcement beam element 10, the second inner reinforcement beam element 12 and the outer reinforcement beam elements, 15, 17 and 18 are made of sheet metal.

In the embodiments shown in the figures, the first and second inner reinforcement beam elements, 10 and 12, and the outer reinforcement beam elements, 15, 17, 18, 20, 21 and 22 have substantially U-shaped cross sectional profiles, as seen in sectional planes taken perpendicularly to the width direction w. It shall however be noted that also other cross sectional shapes enclosing an area may be used, such as V-shape, semi-circular shapes etc., as e.g. described in the above.

Moreover, the first and the second inner reinforcement beam elements 10 and 12 abut each other substantially at a central sectional plane taken perpendicularly to the width direction, which central sectional plane is located substantially halfways in-between the first and the second side walls 5 and 6 as seen in the bucket's 1 width direction w, with substantially equal distances to the first and the second side walls.

It is to be understood that the present disclosure is not limited to the embodiments described above and illustrated in the drawings; rather, the skilled person will recognize that many changes and modifications may be made within the scope of the appended claims.

The invention claimed is:

1. A bucket for an earth-working or materials-handling machine, comprising, a top portion comprising a web section, a first side wall and a second side wall, a bucket floor extending from a front cutting edge of the bucket up to the top portion, the front cutting edge, the first and second side walls and the top portion forming an opening of the bucket, seen from a front view of the bucket, wherein the top portion, the first and second side walls, and the bucket floor cooperate to partly enclose an inside of the bucket, a first inner reinforcement beam element provided on the inside of the bucket adjacent the opening, connecting the first side wall to the web section and extending in a width direction of the bucket from the first side wall towards the second side wall, wherein the first inner reinforcement beam element and the web section, as seen in sectional planes taken perpendicularly to the width direction, form a first plurality of outer perimeter profiles enclosing respective areas, a second inner reinforcement beam element provided on an inside of the bucket adjacent the opening, connecting the second side wall to the web section and extending in the width direction of the bucket from the second side wall towards the first side wall, wherein the second inner reinforcement beam element and the web section, as seen in sectional planes taken perpendicularly to the width direction, form a second plurality of outer perimeter profiles enclosing respective areas, the first and second inner reinforcement beam elements extending in the width direction such that they abut each other at a region between the first and the second side walls and the first and the second inner reinforcement beam elements further being formed such that respective heights of each of the first and second pluralities of outer perimeter profiles decrease along the width direction towards the region between the first and the second side walls where the first and second inner reinforcement beam elements abut.

2. The bucket according to claim 1, wherein the bucket, on an outside thereof, comprises a connection member for connecting the bucket to the earth-working or materials-handling machine.

3. The bucket according to claim 2, wherein the connection member is attached to the web section.

4. The bucket according to claim 3, wherein the connection member is further attached to an outside of the bucket floor.

5. The bucket according to claim 1, wherein a portion of the web section extends outwardly from the opening in an opposite direction with respect to a filling direction for the bucket, forming an outwardly extending web section portion.

6. The bucket according to claim 5, wherein the outwardly extending web section portion further protrudes downwardly towards the front cutting edge.

7. The bucket according to claim 5, wherein the bucket, on an outside thereof, comprises a connection member for connecting the bucket to the earth-working or materials-handling machine, wherein the connection member is attached to the outwardly extending web section portion.

8. The bucket according to claim 1, wherein at least one of the side walls comprises a side wall portion in the proximity of the top portion, which side wall portion extends in the width direction towards the web section.

9. The bucket according to claim 8, wherein the side wall portion is attached to the web section.

10. The bucket according to claim 9, wherein the bucket comprises a bucket corner between the respective side wall and the top portion, wherein the side wall portion is attached to the web section by a weld, wherein the weld is offset from the bucket corner.

11. The bucket according to claim 1, further comprising at least one outer reinforcement beam element provided on an outside of the bucket, on the top portion thereof and adjacent the opening, connecting the first and the second side walls to the web section and extending in the width direction of the bucket between the first and second side walls, wherein the at least one outer reinforcement beam element and the web section, as seen in sectional planes taken perpendicularly to the width direction, forms a third plurality of outer perimeter profiles enclosing respective areas.

12. The bucket according to claim 11, wherein the at least one outer reinforcement beam element is formed such that respective heights of the third plurality of outer perimeter profiles increase towards a region of the top portion in-between the first and second side walls.

13. The bucket according to claim 11, comprising more than one outer reinforcement beam element provided consecutively in the width direction.

14. The bucket according to claim 1, wherein the web section comprises an end portion being distal to the opening, the distal end portion comprising a protruding portion extending in the width direction and protruding downwardly towards the inside of the bucket through a slit of the bucket floor.

15. The bucket according to claim 11, wherein at least one of the web section, the first inner reinforcement beam element, the second inner reinforcement beam element and the at least one outer reinforcement beam element is made of sheet metal.

16. The bucket according to claim 1, wherein the first and the second inner reinforcement beam elements are formed such that the respective heights of each of the first and second pluralities of outer perimeter profiles continuously decrease along the width direction from the respective one of the first and second side walls to the region between the first and the second side walls where the first and second inner reinforcement beam elements abut.

* * * * *